US005459295A

United States Patent [19]

Ohta et al.

[11] Patent Number: 5,459,295

[45] Date of Patent: Oct. 17, 1995

[54] RELIABLE ELECTRICAL CONNECTION BETWEEN A STATIONARY TERMINAL AND AN ARMATURE OF A SWITCH

[75] Inventors: Fumitaka Ohta; Masayuki Maeda, both of Kyoto; Isao Kato, Fukui; Tomonori Morimura, Kyoto; Hiroyoshi Yamada, Tottori, all of Japan

[73] Assignee: Omron Corporation, Kyoto, Japan

[21] Appl. No.: 106,987

[22] Filed: Aug. 16, 1993

[30] Foreign Application Priority Data

Aug. 14, 1992 [JP] Japan ..... 4-216894
Feb. 10, 1993 [JP] Japan ..... 5-022453

[51] Int. Cl.[6] ..... H01H 5/18

[52] U.S. Cl. ..... 200/461; 200/244

[58] Field of Search ..... 200/459, 460, 200/461, 467, 244

[56] References Cited

U.S. PATENT DOCUMENTS

| | | | |
|---|---|---|---|
| 2,509,194 | 5/1950 | Thorsheim | 200/467 |
| 2,743,331 | 4/1956 | Lauder et al. | 200/461 |
| 4,254,313 | 3/1981 | Badder | 200/461 X |
| 5,111,010 | 5/1992 | Kokubu et al. | 200/461 |

FOREIGN PATENT DOCUMENTS

| | | | |
|---|---|---|---|
| 632699 | 12/1961 | Canada | 200/461 |
| 922898 | 4/1982 | U.S.S.R. | 200/461 |
| 1012705 | 12/1965 | United Kingdom . | |
| 2020486 | 11/1979 | United Kingdom . | |

*Primary Examiner*—Renee S. Luebke
*Attorney, Agent, or Firm*—Fish & Richardson

[57] ABSTRACT

A switch in which an armature swingably coupled to a stationary terminal is operated by a depression of a push button to trip between the contacts. A movable spring is laid between the stationary terminal and the armature to assist the trip of the armature and the stationary terminal is welded to the armature. The switch can be manufactured relatively readily without increase in the number of components, and is high in the reliability in electrical connection of the stationary terminal and the armature.

5 Claims, 12 Drawing Sheets

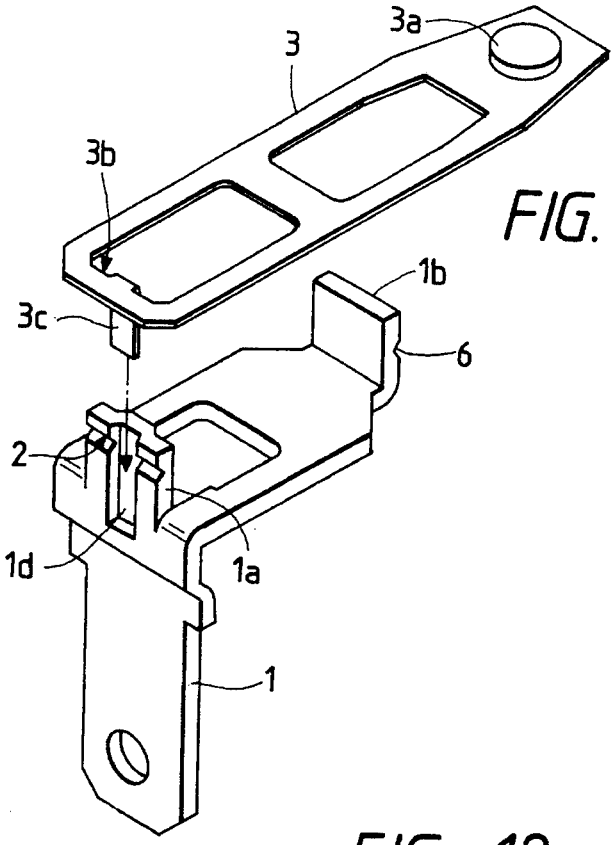
FIG. 11
FIG. 12
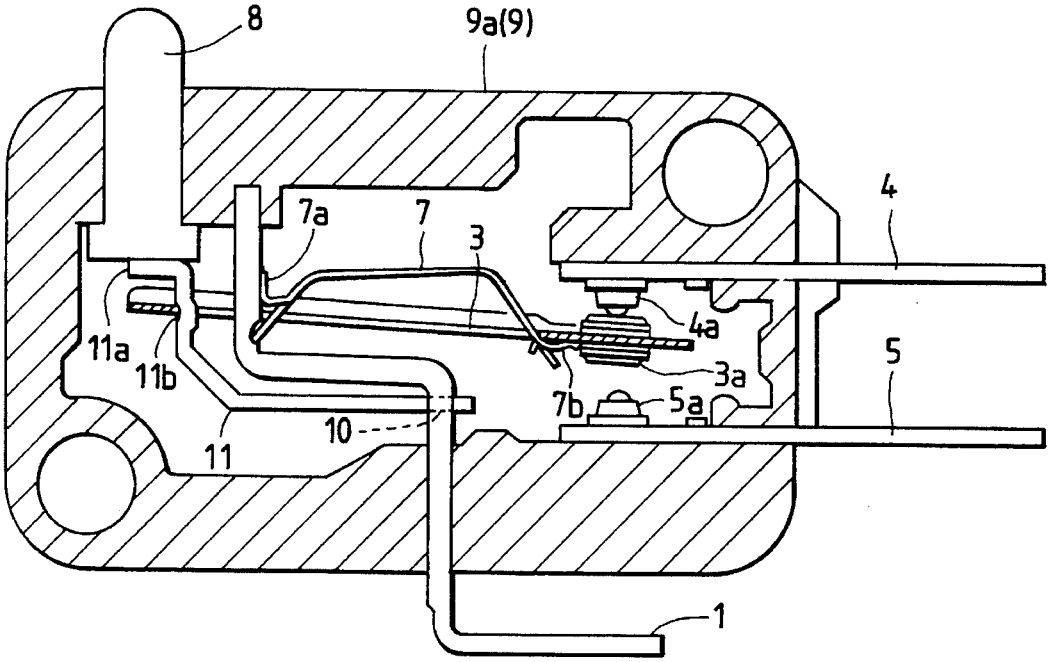

RELIABLE ELECTRICAL CONNECTION BETWEEN A STATIONARY TERMINAL AND AN ARMATURE OF A SWITCH

BACKGROUND OF THE INVENTION

This invention relates to an electrical connection structure for a stationary terminal and a movable piece in a micro switch or the like.

One example of a conventional micro switch is as shown in FIGS. 22 and 23.

The micro switch comprises: a stationary terminal 1 which is a common terminal, and a pair of stationary terminals 4 and 5 which are fixedly inserted in a resin casing 9; a switching movable piece 3 having its base end portion engaged with a V-shaped engaging groove formed in one engaging piece 1*a* of the stationary terminal 1 (hereinafter referred to as "an armature 3", when applicable), and a movable contact 3*a* provided on its free end portion in such a manner that the movable contact appears on both sides (the upper and lower surfaces) of the free end portion; a movable spring 7 for operating the armature with a snap, the spring 7 having its base end portion engaged with a V-shaped engaging groove 6 formed in the other engaging piece 1*b* of the stationary terminal 1 and its free end portion engaged with the free end portion of the armature 3; and a push button 8 supported by the casing in such a manner that it is pushed against the middle of the armature 3 when depressed. In the normal state of the micro switch; that is, when the push button 8 is not depressed yet, as shown in FIGS. 22 and 23 the free end portion of the armature 3 is urged upwardly by the elastic restoring force of the movable spring 7, so that the movable contact 3*a* is held in contact with the contact of the stationary terminal 4 (which is a normally closed contact). When, under this condition, the push button 8 is depressed, the middle of the armature 3 is displaced below a predetermined position, instantaneously the armature 3 is urged downwardly by the elastic restoring force of the movable spring 8 (snap action), so that the movable contact 3*a* is tripped over to the contact 5*a* of the other stationary terminal 5 (which is a normally open contact). Thus, the switching operation has been accomplished.

In the above-described micro switch, the contact resistance of the switch occurs not only in a portion between the contact 3*a* and either of the contacts 4*a* and 5*a* but also in each of engaging portions between the stationary terminal 1 and the armature 3, between the movable Spring 7 and the stationary terminal 1 and between the movable spring 7 and the armature 3.

However, the frequent slide motion in the engaging portions makes the contact resistance unstable, as a result of which the switch is liable to become low in contact reliability. Furthermore, sometimes the micro switch suffers from the following difficulty: When the contact resistance increases, heat is generated to increase the temperature of the micro switch, thus adversely affecting the durability of the latter. Thus, there is much room for improvement in the durability of the conventional micro switch.

In order to improve the contact between the engaging groove 2 and the armature 3 in reliability, there has been proposed a method in which the engaging portions of the engaging groove 2 and the armature 3 are plated with silver. However, the method is not economical because the sliver plating will increase the manufacturing cost of the micro switch.

In order to improve the reliability in electrical connection of the stationary terminal 1 and the armature 3, a method has been proposed in which, as shown in FIG. 21, both ends of a lead wire 12 are soldered to the portions of the stationary terminal 1 and the armature 3 which are less displaced from each other. However, the method is also disadvantageous in that the number of components and the number of manufacturing steps are increased as much, and accordingly the manufacturing cost is increased.

SUMMARY OF THE INVENTION

In view of the foregoing, an object of this invention is to provide a switch which can be manufactured relatively readily without increase of the number of components, and is high in the reliability in electrical connection of the stationary terminal and the armature.

The foregoing object of the invention has been achieved by the provision of a first switch in which an armature swingably coupled to a stationary terminal is operated by depression of a push button to trip between contacts, and in which, the stationary terminal and the armature are partially welded to each other. In the first switch, the stationary terminal and the armature coupled to it are stably electrically connected to each other through the welded portions.

In the first switch, it is possible that the armature is swingably engaged with the stationary terminal through their engaging portions, and the armature and the stationary terminal are welded to each other by using portions thereof other than the engaging portions. The armature and the stationary terminal are electrically connected to each other by using their portions which are other than their engaging portions through which the armature and the stationary terminal are mechanically coupled to each other. That is, in the switch, the mechanical connection and the electrical connection of the stationary terminal and the armature are established independently of each other.

In the first switch, it is also possible that an engaging groove is formed in an engaging piece of the stationary terminal, the base end portion of the armature is engaged with the engaging groove, a first tongue piece extended from the armature is laid on a second tongue piece formed by bending the middle portion of the engaging piece, and the two tongue pieces are welded together. The welding portions of the stationary terminal and the armature are located between the engaging portions through which the stationary terminal and the armature are mechanically engaged with each other; that is, the welding portions are located where the stationary terminal and the armature are less displaced from each other. Hence, the welding portions will not interfere the motion of the armature. The first tongue piece extended from the armature may be bent, and the end portion of the first tongue piece thus bent may be welded to the second tongue piece formed by bending the middle portion of the engaging piece. The tongue piece extended from the armature is bent, and therefore although the end of the tongue is welded to the stationary terminal, the armature can be swung (or tripped) smoothly with the engaging portion as a fulcrum.

In the first switch, it is also possible that an engaging groove is formed in an engaging piece of the stationary terminal, the base end portion of the armature is engaged with the engaging groove thus formed, an engaging recess is formed in the outer surface of the middle portion of the engaging piece, and a tongue piece extended from the armature is engaged with the engaging recess, and welded to the stationary terminal. The welding portions of the stationary terminal and the armature are located where the stationary terminal and the armature are less displaced from each other, and the welding portions will never interfere with the motion of the armature. In the switch, the engaging piece of the stationary terminal, having no cut, is high rigidity.

Further, the foregoing object of the invention has been also achieved by the provision of a second switch in which an armature swingably coupled to a stationary terminal is operated by depression of a push button to trip between the contacts, and in which a movable spring is laid between the stationary terminal and the armature and supported by and welded to the stationary terminal and the armature. The elastically movable spring is welded to the stationary terminal and the armature, and therefore the welding portions scarcely resist the tripping motion of the armature.

Moreover, the foregoing object of the invention has been also achieved by the provision of a third switch in which an armature swingably coupled to a stationary terminal is operated by depression of a push button to trip between the contacts, and in which an engaging groove is formed in an engaging piece of the stationary terminal, the base end portion of the armature is engaged with the engaging groove thus formed, a tongue piece extended from the armature is placed on a tongue piece protruded from the stationary terminal independently of the engaging piece, and the two tongue pieces are welded together. The engaging piece supporting the base end portion of the armature on the stationary terminal, and the tongue piece onto which the tongue piece of the armature is welded, are formed independently of each other. Therefore, when those tongue pieces are bent which are formed by cutting the stationary terminal, they will not interfere with each other, and therefore they can be formed with high accuracy.

BRIEF DESCRIPTION OF THE DRAWINGS

In the accompanying drawings:

FIG. 11 is an exploded perspective view of essential components of the switch shown in FIG. 10;

FIG. 12 is a vertical sectional view showing a switch, which constitutes a fifth embodiment of the invention;

DETAILED DESCRIPTION OF THE PREFERRED EMBODIMENTS

Figure 1:
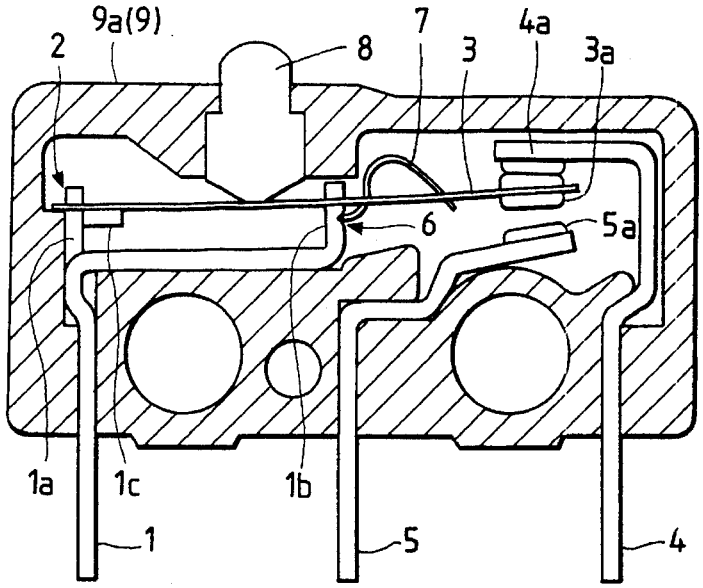
FIG. 1 is a vertical sectional view showing a switch, which constitutes a first embodiment of this invention.
Figure 2:
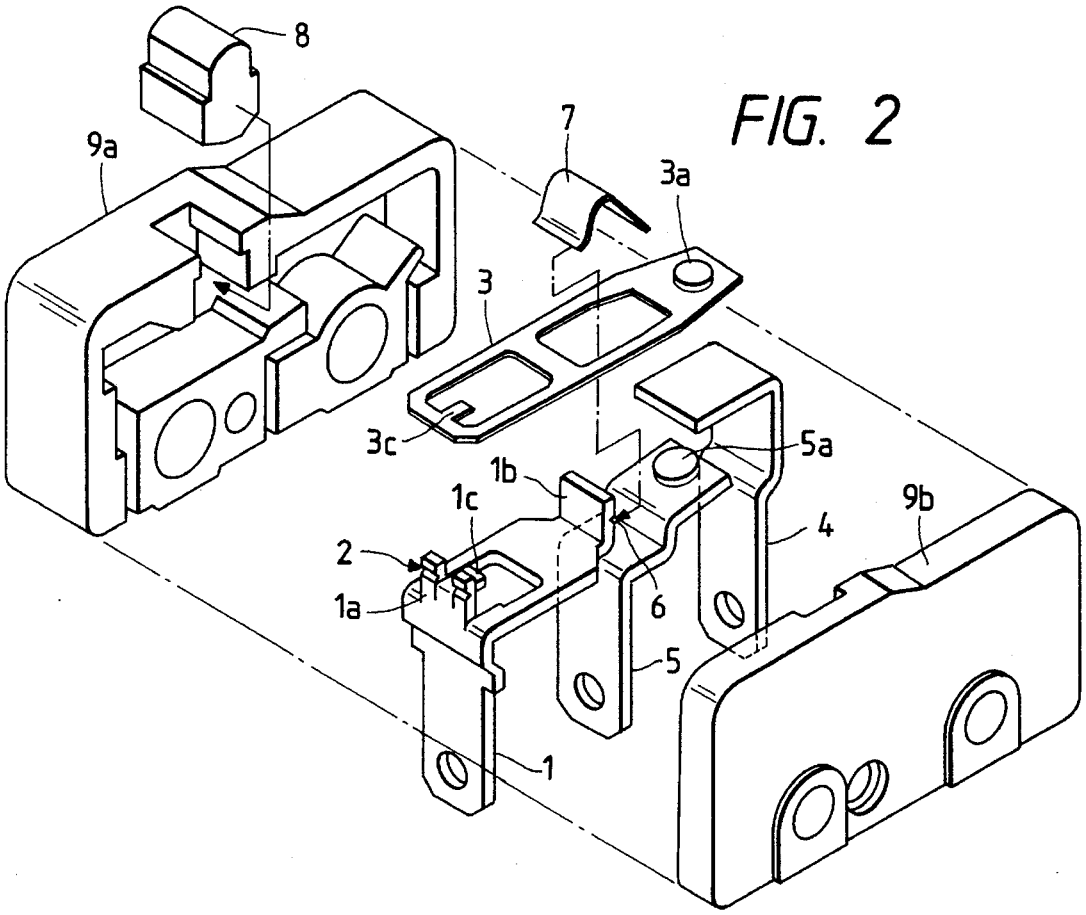
FIG. 2 is an exploded perspective view of the switch shown in FIG. 1.
Figure 3:
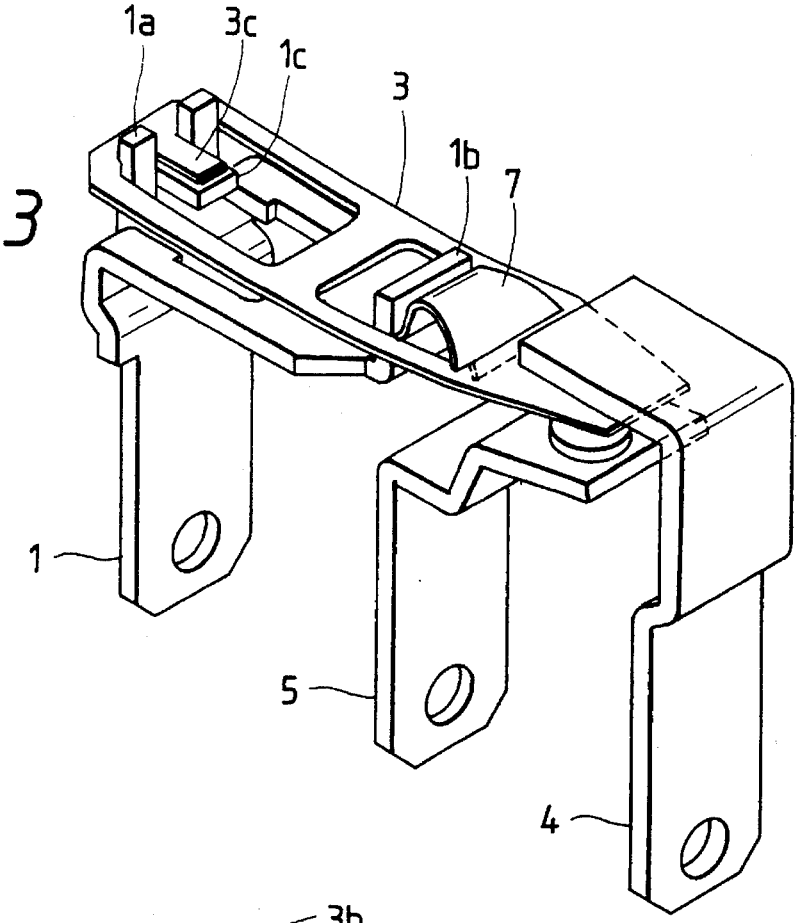
FIG. 3 is a perspective view showing essential components of the switch shown in FIG. 1.
Figure 4:
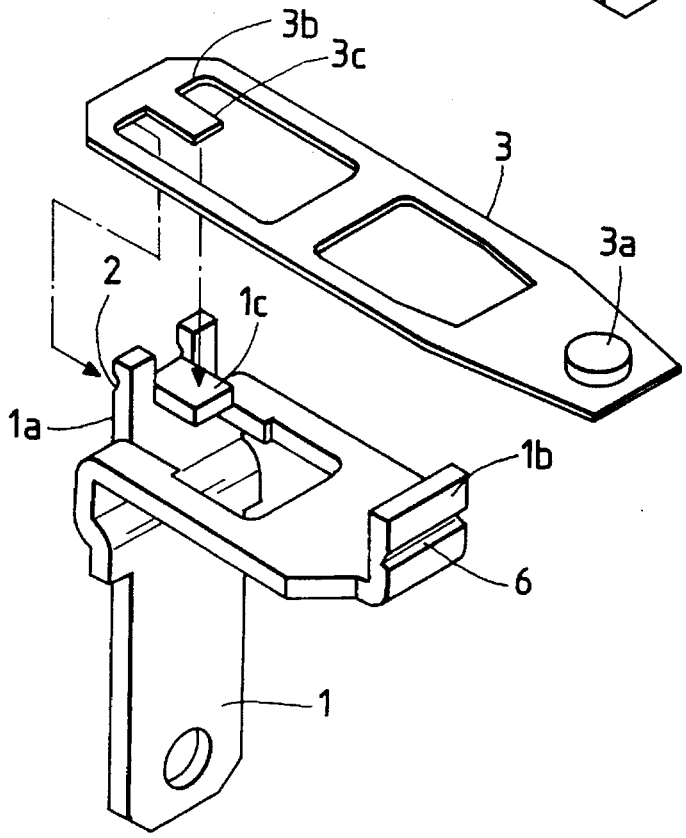
FIG. 4 is an exploded perspective view of essential components of the switch shown in FIG. 1.

Preferred embodiments of this invention will be described with reference to the accompanying drawings.

First Embodiment

A switch, which constitutes a first embodiment of the invention, is as shown in FIGS. 1 through 4. The switch is equal in fundamental structure to the above-described conventional switch. That is, the switch comprises: a stationary terminal 1 which is a common terminal with a pair of engaging pieces 1*a* and 1*b*; a movable piece 3 having its base end portion engaged with a V-shaped engaging groove 2 formed in the engaging piece 1*a* of the stationary terminal 1, and a movable contact 3*a* provided on its free end portion in such a manner that the movable contact appears on both sides (the upper and lower surfaces) of the free end portion (hereinafter referred to as "an armature 3", when applicable); a stationary terminal 4 which is a normally closed terminal with a stationary contact 4*a* which is confronted with the movable contact 3*a* from above; a stationary terminal 5 which is a normally open terminal having a stationary contact 5*a* which is confronted with the movable contact 3*a* from below; a movable spring 7 for operating the armature with a snap, the spring 7 having its base end portion engaged with a V-shaped engaging groove 6 formed in the other engaging piece 1*b* of the stationary terminal 1 and its free end portion engaged with the free end portion of the armature 3; and a push button 8 which is pushed against the middle of the armature 3. Those components 1 through 8 are fixedly held by a resin casing 9 which is made up of a casing body 9*a* and a cover casing 9*b*.

In the normal state of the switch; i.e., when the push button 8 is not pushed yet, as shown in FIG. 1 the free end portion of the armature 3 is urged upwardly by the elastic restoring force of the movable spring 7, so that the stationary contact (or normally closed contact) 4*a* of the stationary terminal 4 is held in contact with the upper surface of the movable contact 3*a* of the armature 3. When the pushed button 8 is pushed, the middle of the armature 3 is deflected downwardly, so that, when the engaging point of the armature 3 and the spring 7 goes across the prolongation (or dead point) of the straight line connecting the two engaging grooves 2 and 6, instantaneously the armature is displaced downwardly with a snap by the elastic restoring force of the spring 7. As a result, the lower surface of the movable contact 3*a* is brought into contact with the stationary contact (or normally open contact) of the stationary terminal 5.

In the stationary terminal 1, a tongue piece 1*c* is extended from the middle, in the direction of width, of the engaging piece 1*a*, and bent sidewards. The armature 3 has an engaging edge 3*b*, which is engaged with the engaging piece 1*a* of the stationary terminal 1. A tongue piece 3*c* is extended from the engaging edge 3*b* in such a manner that it is laid on the tongue piece 1*c* of the stationary terminal 1. The two tongue pieces 1*c* and 3*c* are welded together at the ends by soldering, so that the stationary terminal 1 and the armature 3 are positively electrically connected with each other. Those tongue pieces 1*c* and 3*c* may be connected by laser welding or spot welding.

Second Embodiment

Figure 5:
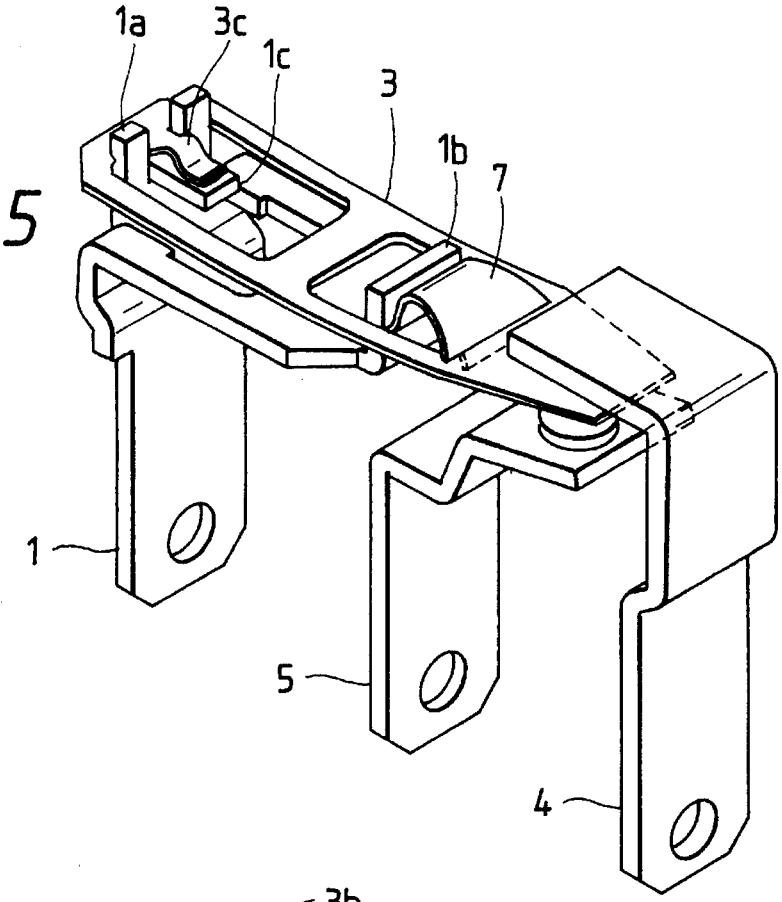
FIG. 5 is a perspective view showing essential components of a switch, which constitutes a second embodiment of the invention.
Figure 6:
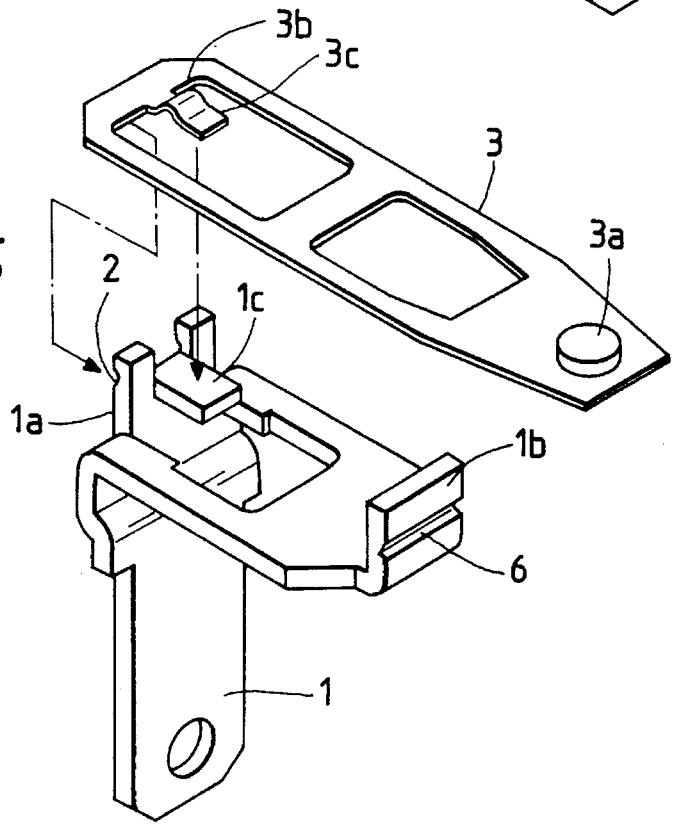
FIG. 6 is an exploded perspective view of essential components of the switch shown in FIG. 5.

A second embodiment of the invention is as shown in FIGS. 5 and 6. The second embodiment is also similar in fundamental structure to the above-described first embodiment. In the second embodiment, the tongue piece 3*c* of the armature 3 is longer than in the first embodiment, and it is curved. The end portion of the tongue piece 3*c* thus curved is connected to the tongue piece 1*c* of the stationary terminal 1 by soldering or laser welding or spot welding. The welding of the tongue pieces in this manner scarcely affects the motion of the armature; that is, the armature 3 can be smoothly tripped with a snap.

Third Embodiment

Figure 7:
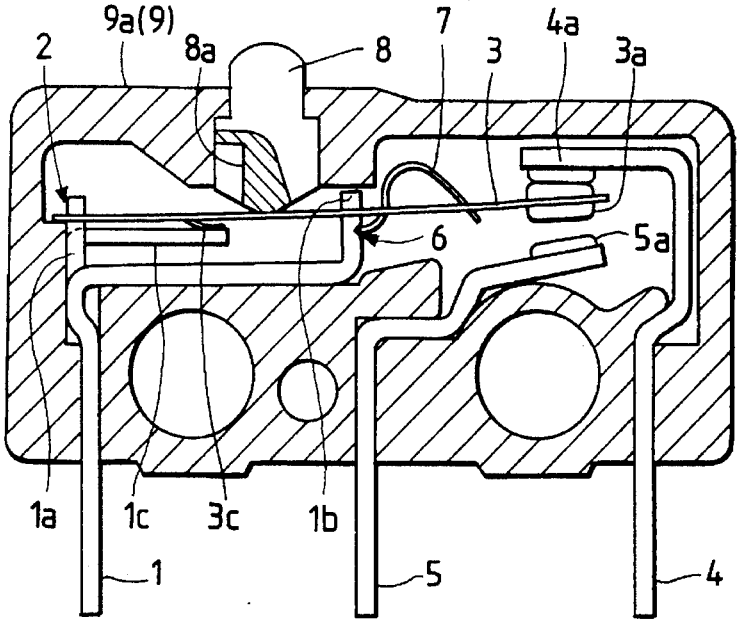
FIG. 7 is a vertical sectional view showing a switch, which constitutes a third embodiment of the invention.
Figure 8:
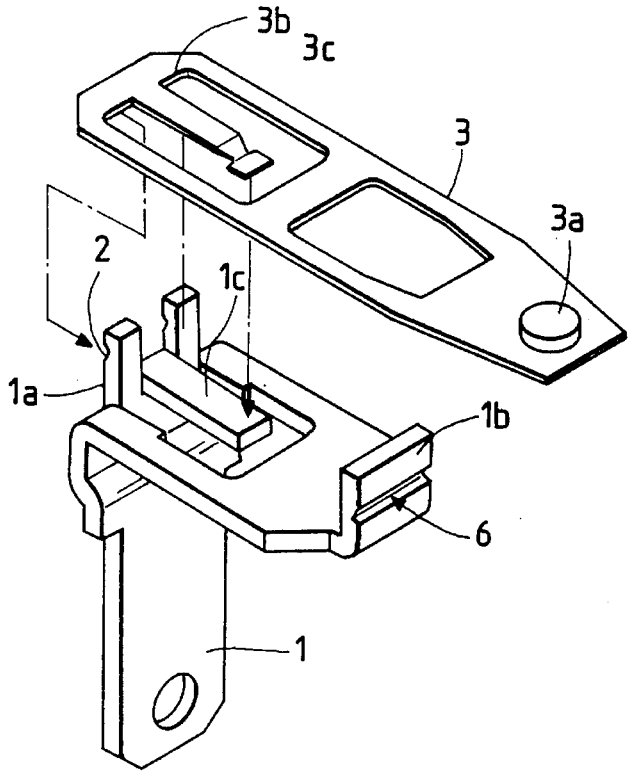
FIG. 8 is an exploded perspective view of essential components of the switch shown in FIG. 7.
Figure 9:
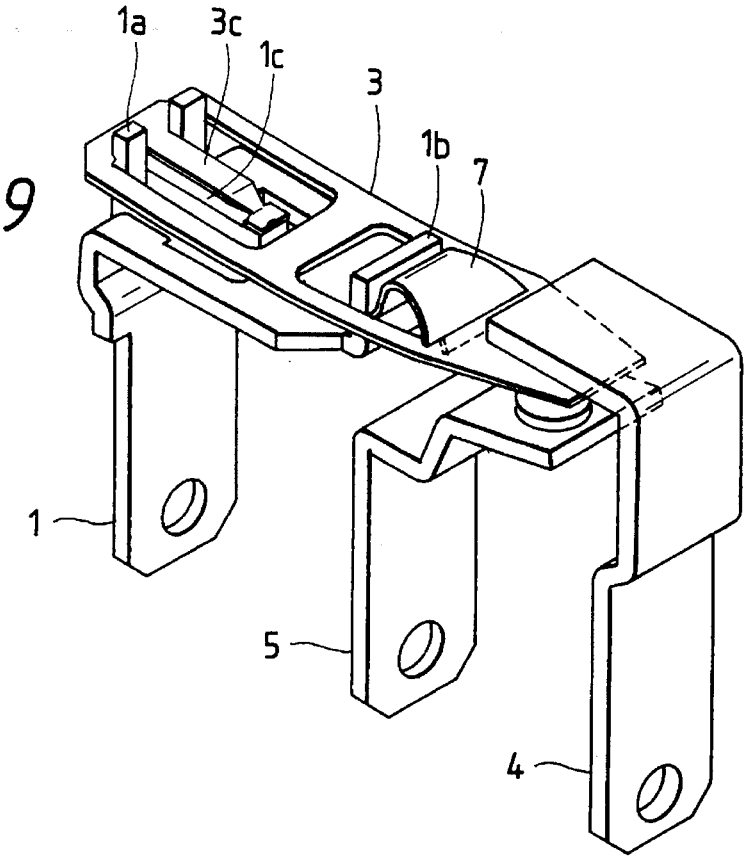
FIG. 9 is a perspective view of essential components of the switch shown in FIG. 7.

A third embodiment of the invention is as shown in FIGS. 7 through 9. The third embodiment is also similar in fundamental structure to the above-described first embodiment. In the third embodiment, the tongue piece 1*c* is extended longer from the middle of the engaging piece 1*a* of the stationary terminal 1 than in the first embodiment, and is bent sidewards at a level lower than in the first embodiment. The tongue piece 3*c* is extended long from the armature 3, and bent downwardly at the end. The tongue piece 3*c* is set above the tongue piece l*c*, and under this condition the free ends of those tongue pieces 3*c* and 1*c* are connected together by soldering, laser welding or spot welding. Hence, the adverse effect of the welding of the tongues pieces on the motion of the armature can be more positively eliminated; that is, the armature 3 can be more smoothly tripped with a snap. In the third embodiment, the push button 8 has a recess 8*a* to eliminate its interference with the tongue pieces 1*c* and 3*c*.

Fourth Embodiment

Figure 10:
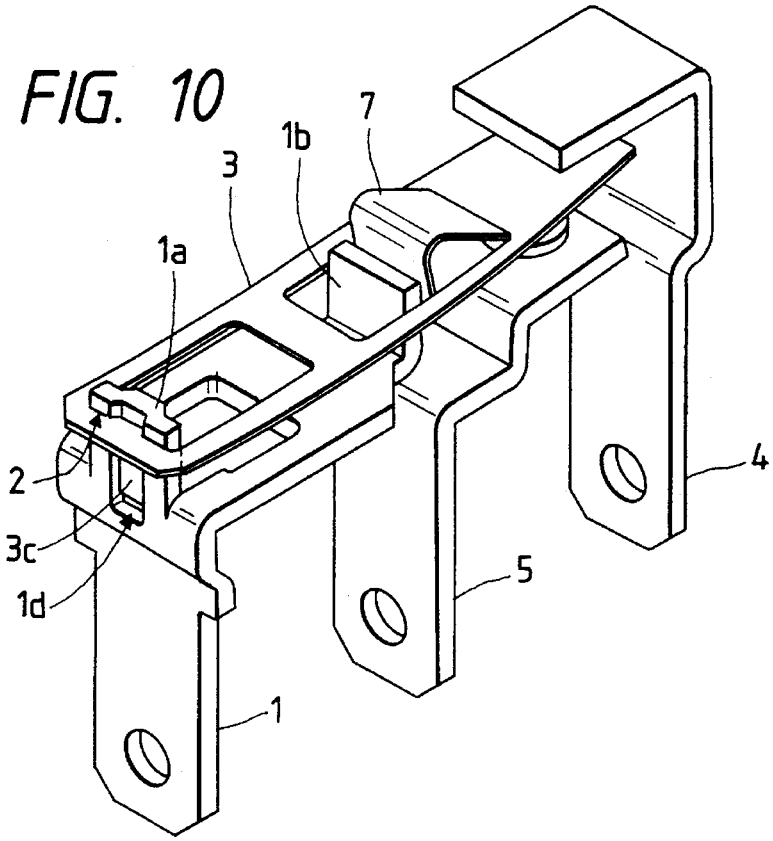
FIG. 10 is a perspective view of essential components of a switch, which constitutes a fourth embodiment of the invention.

A fourth embodiment of the invention is as shown in FIGS. 10 and 11. The fourth embodiment is also similar in fundamental structure to the above-described first embodiment. In the fourth embodiment, an engaging recess 1*d* is formed in the outer surface of the engaging piece 1*c* at the middle by pressing. A tongue piece 3*c* is extended downwardly from the engaging edge 3*b* of the armature 3 which is engaged with the engaging piece 1*a* of the stationary terminal 1. The tongue piece 3*c* thus extended is inserted into the engaging recess 1*d*. Under this condition, the tongue piece 3*c* is connected to the stationary terminal 1 by soldering, laser welding or spot welding.

In each of the above-described first through fourth embodiments of the invention, the stationary terminal 1 and the armature 3 are welded to each other by using their portions which are in direct contact with each other. However, they may be welded by using their portions which are in contact with each other through the movable spring 7.

Fifth Embodiment

Figure 13:
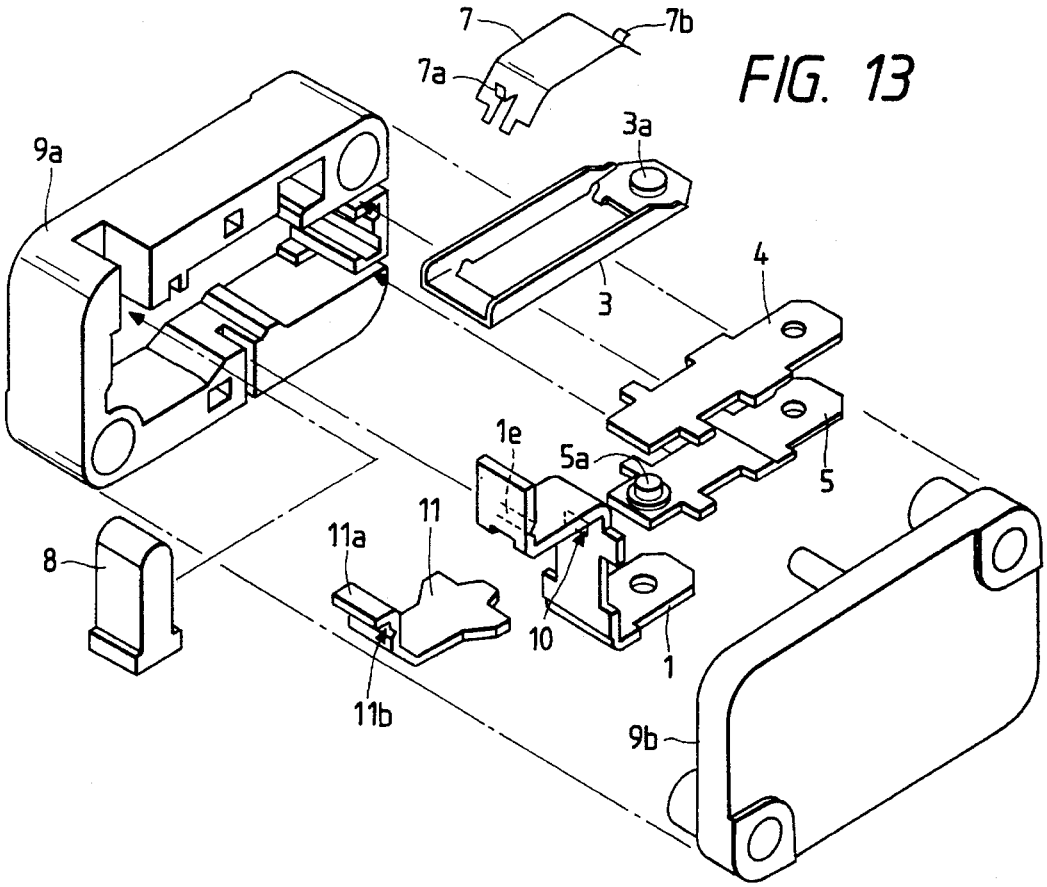
FIG. 13 is an exploded perspective view of essential components of the switch shown in FIG. 12.

A fifth embodiment of the invention is as shown in FIGS. 12 and 13. A switch shown in FIGS. 12 and 13 is different in structure from the above-described switches.

In the switch, its stationary terminal 1 has an engaging hole 10, into which one end portion of an operating metal part 11 is inserted. The other end portion 11*a* of the operating metal part 11 has an engaging groove 11*b*, with which one end portion of an armature 3 is engaged. The stationary terminal 1 has an engaging groove 1*e*, with which one end portion of a movable spring 7 is engaged. The other end portion of the spring 7 is engaged with the free end portion of the armature 3. When a push button 8 set in a casing 9 is depressed, the other end portion 11*a* of the operating metal part 11 is moved downwardly thereby. As a result, the armature 3 is tripped with a snap by the elastic restoring force of the spring 7, so that the movable contact 3*a* of the armature 3 is moved from the contact (or normally closed contact) 4*a* of an upper stationary terminal 4 over to the contact (or normally open contact) 5*a* of a lower stationary terminal 5.

The movable spring 7 has tongue pieces 7*a* and 7*b* at both ends which are formed by cutting for the stationary terminal 1 and the armature 3, respectively. The ends of those tongue pieces 7*a* and 7*b* are connected to the stationary terminal 1 and the armature 3 by soldering, laser welding or spot welding. Thus, the stationary terminal 1 is electrically stably connected to the armature 3 through the movable spring 7.

Sixth Embodiment

Figure 14:
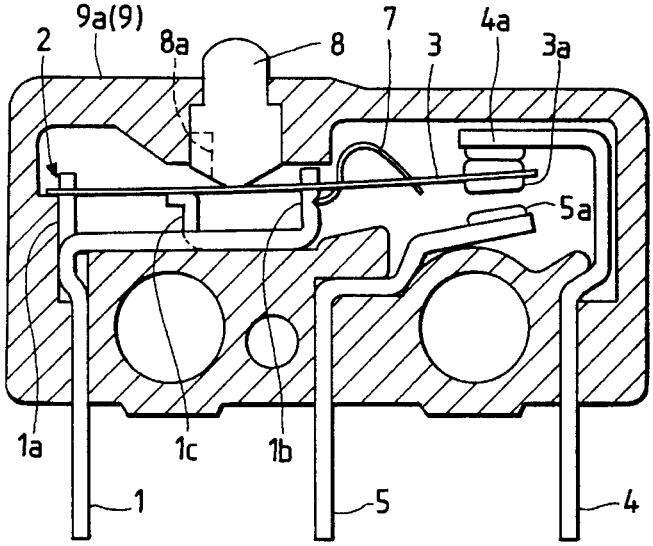
FIG. 14 is a vertical sectional view showing a switch, which constitutes a sixth embodiment of the invention.
Figure 15:
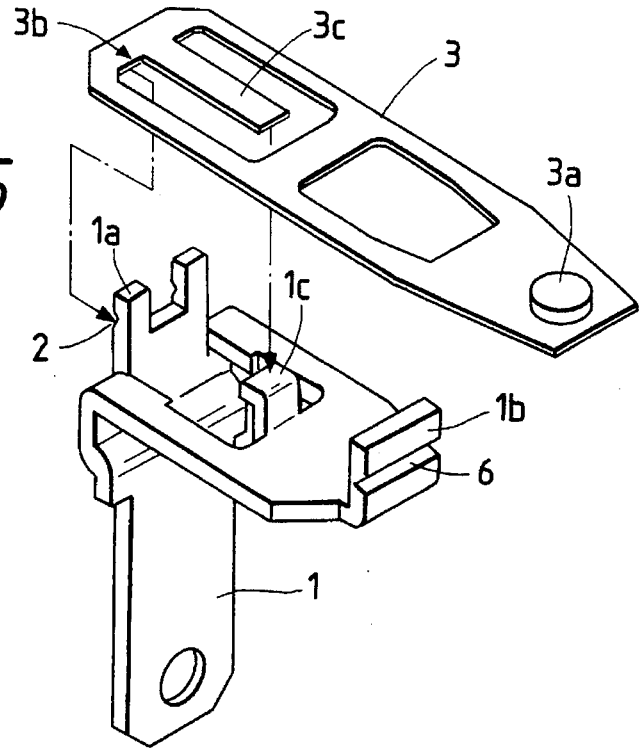
FIG. 15 is an exploded perspective view of essential components of the switch shown in FIG. 14.
Figure 16:
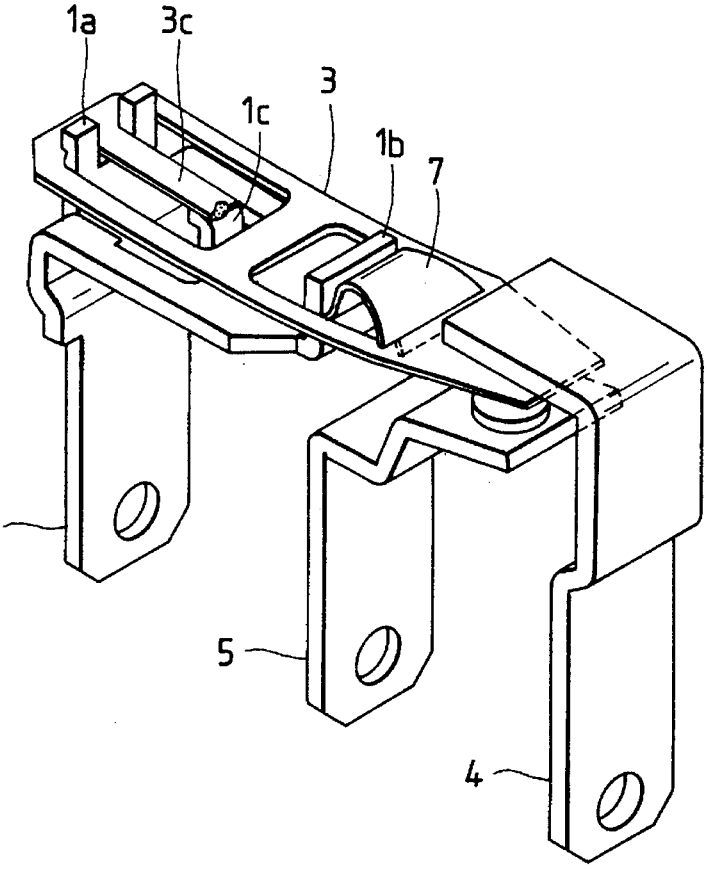
FIG. 16 is a perspective view of essential components of the switch shown in FIG. 14.
Figure 17:
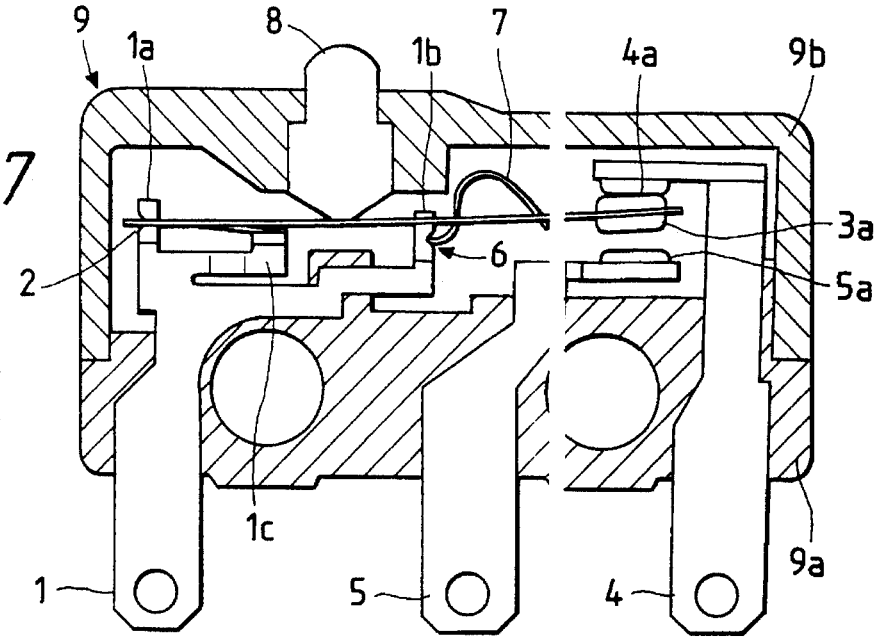
FIG. 17 is a vertical sectional view showing a switch, which constitutes a seventh embodiment of the invention.
Figure 18:
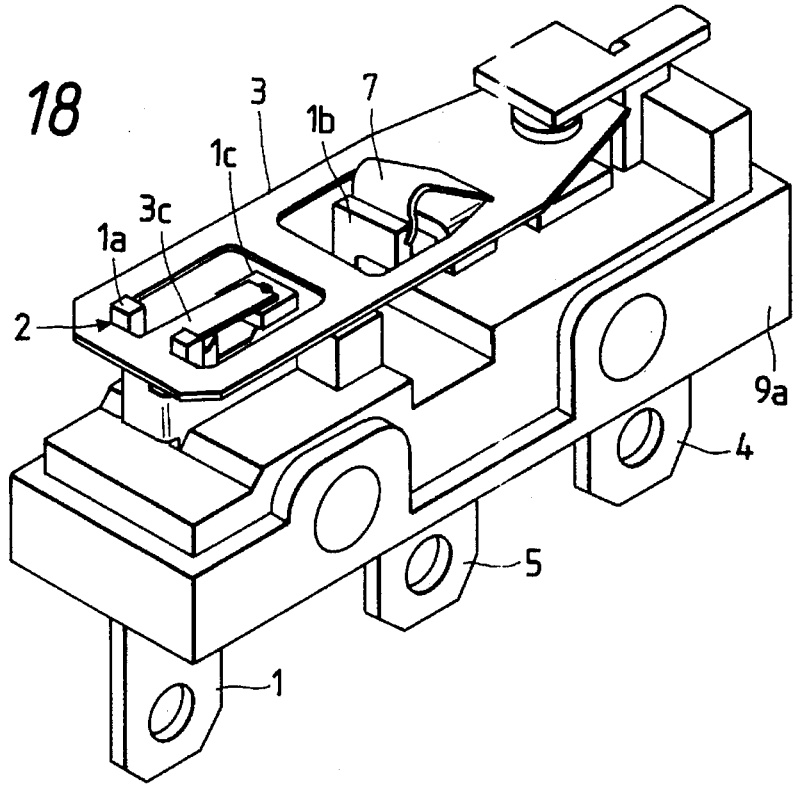
FIG. 18 is a perspective view of essential components of the switch shown in FIG. 17.
Figure 19:
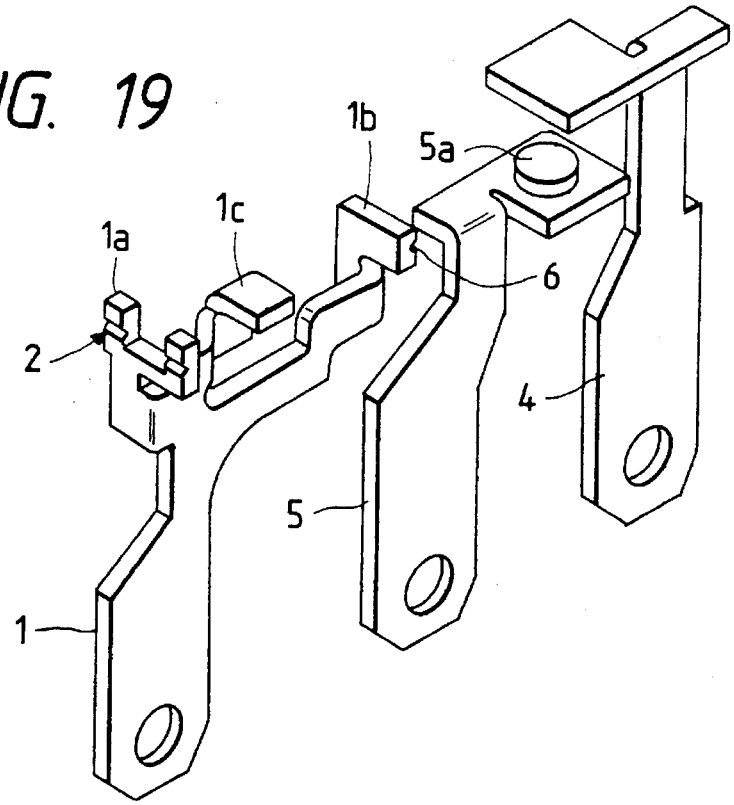
FIG. 19 is a perspective view showing the stationary terminals of the switch shown in FIG. 17.
Figure 20:
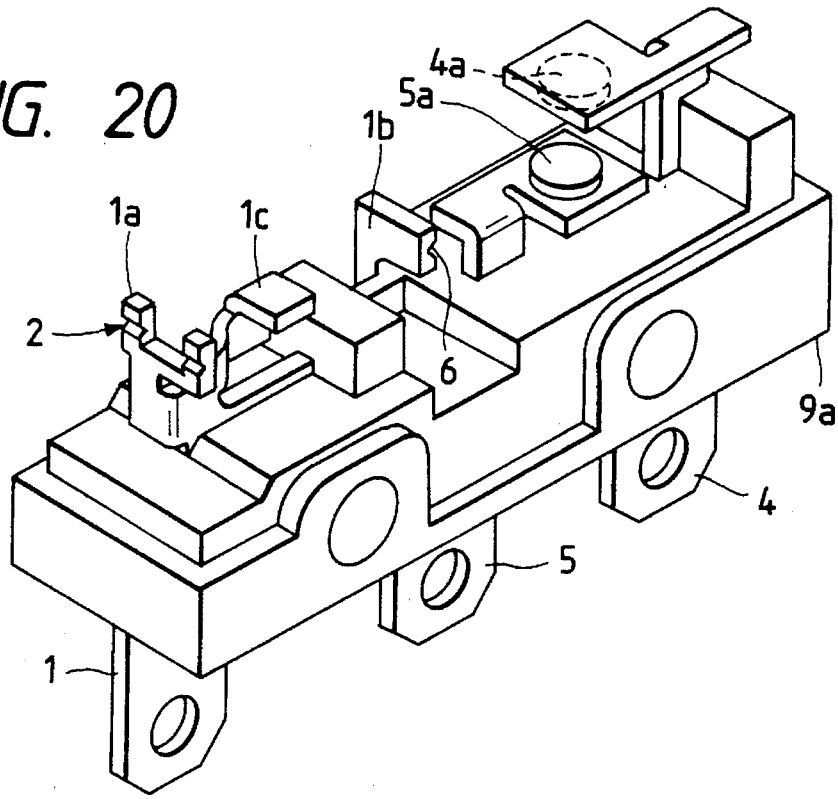
FIG. 20 is a perspective view showing the stationary terminals assembled in the switch shown in FIG. 17.
Figure 21:
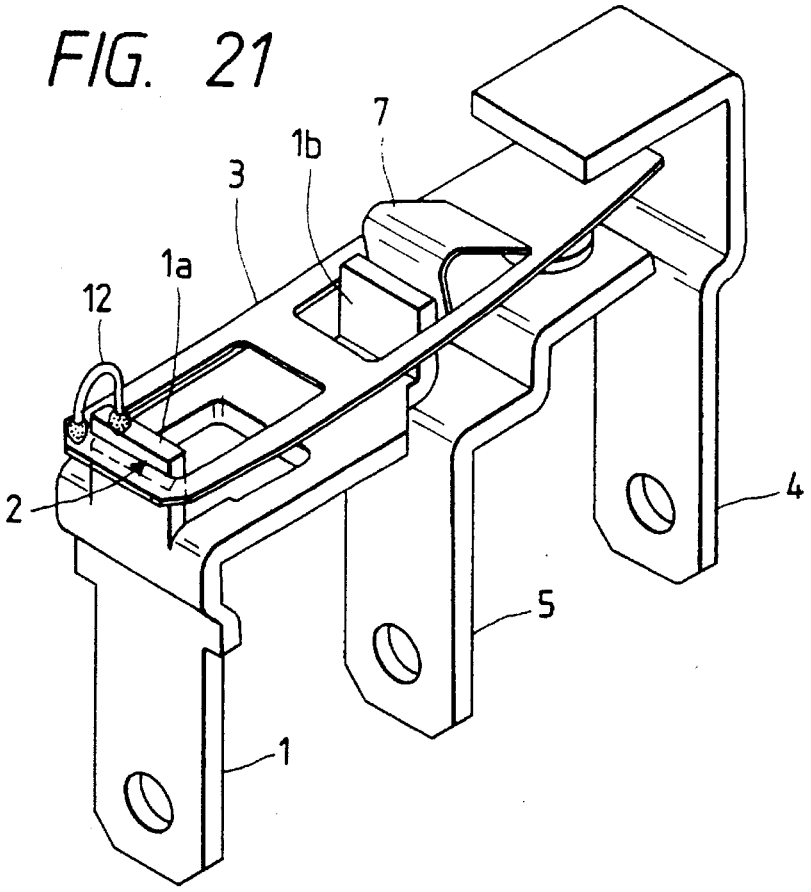
FIG. 21 is a perspective view showing essential components of a comparative example of the switch.
Figure 22:
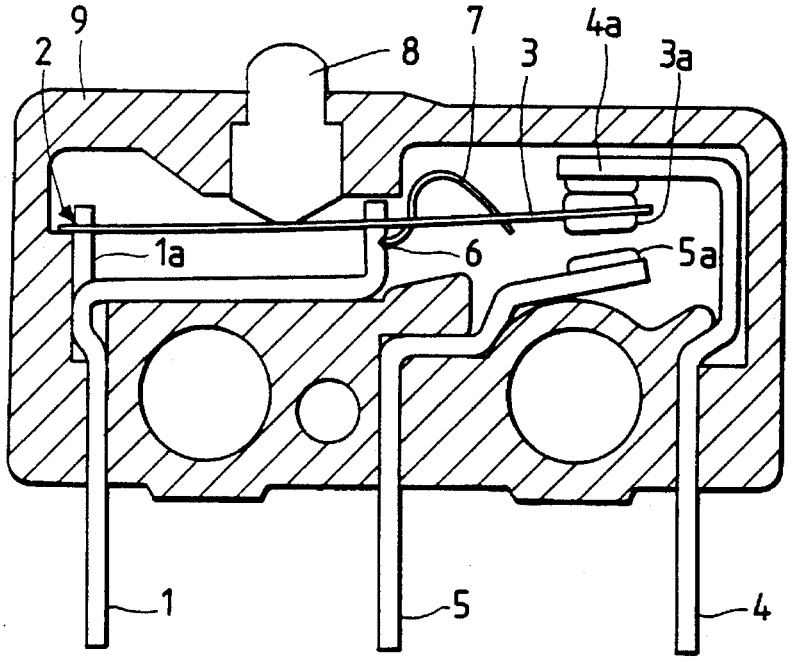
FIG. 22 is a vertical sectional view showing a conventional switch.
Figure 23:
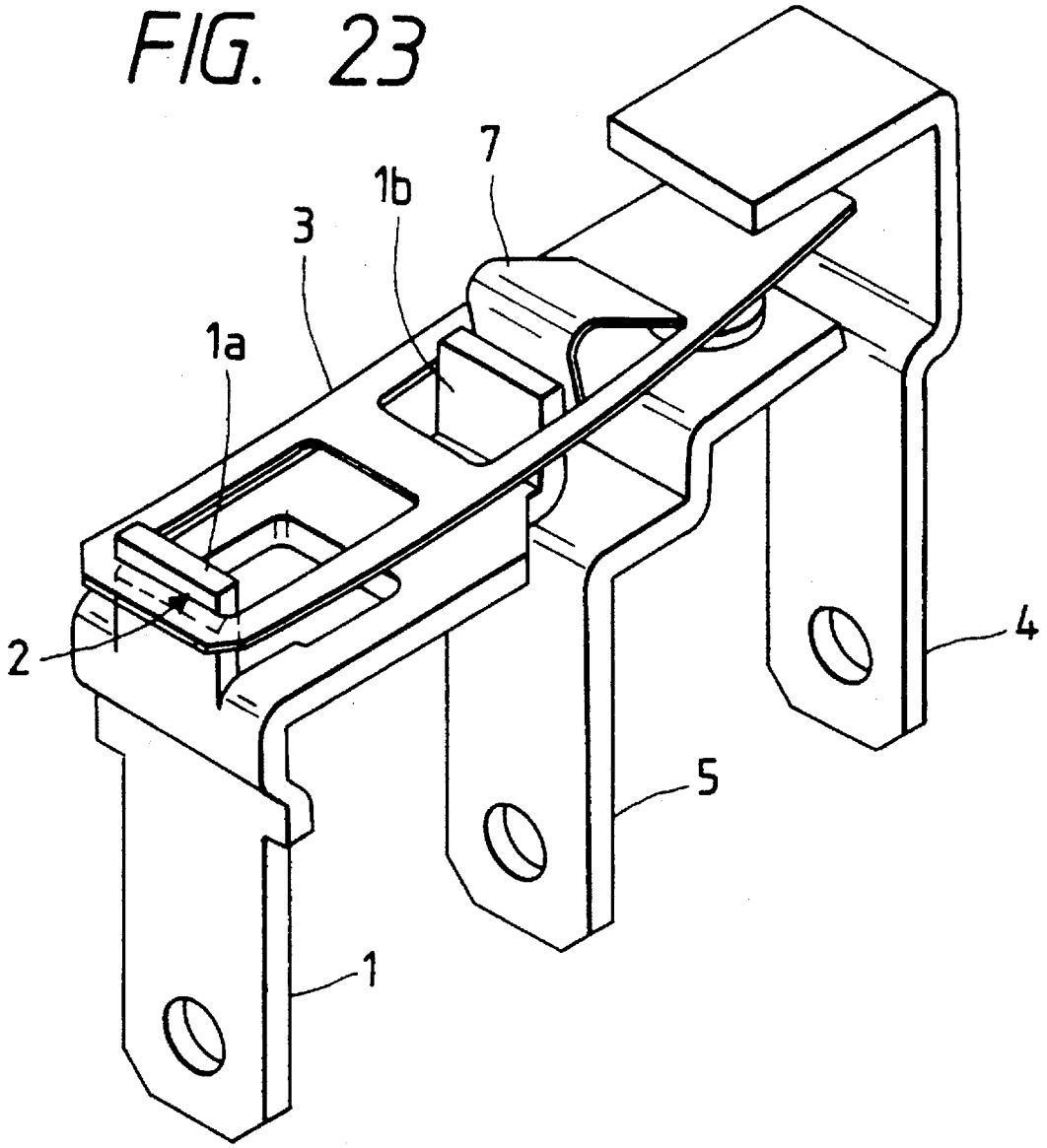
FIG. 23 is a perspective view of essential components of the conventional switch shown in FIG. 22.

A sixth embodiment of the invention is as shown in FIGS. 14 through 16. The sixth embodiment is similar in fundamental structure to the first embodiment. In the sixth embodiment, its stationary terminal 1 has a pair of engaging pieces 1*a* and 1*b* which are bent, and a tongue piece 1*c* between the engaging pieces 1*a* and 1*b*. The tongue piece 1*c* is formed by cutting the body of the stationary terminal 1, and bent at the end. The armature has an elongated tongue piece 3*c*. The end portion of the tongue piece 3*c* is connected to the tongue piece 1*c* by soldering, laser welding or spot welding.

The sixth embodiment is free from the difficulty accompanying the above-described first, second and third embodiments that, since the tongue piece 1*c* is bent when formed by using the engaging piece 1*a*, the latter 1*a* is unavoidably deformed, so that the engaging groove 2 is lowered in positional accuracy.

Seventh Embodiment

A seventh embodiment of the invention is as shown in FIGS. 17 through 20. In a switch shown in those figures, its resin casing 9 is made up of a casing body 9*a* and a cover 9*b* which are separable from each other, and its stationary terminals 1, 4 and 5 are held by the casing body 9*a* in such a manner that they are arranged in a line with their flat base end portions in one plane. The stationary terminal 1 has a pair of engaging pieces 1*a* and 1*b*, and a tongue piece 1*c* at predetermined positions, which are bent independently of one another. The armature 3 has an elongated tongue piece 3*c*, the end of which is connected to the tongue piece 1*c* by soldering, laser welding or spot welding.

As is apparent from the above description, the invention has the following merits or effects:

In a switch of a first aspect of the invention, in which an armature swingably coupled to a stationary terminal is operated by depression of a push button to trip between contacts and the stationary terminal is welded to the armature, the electrical connection of the stationary terminal and the armature is greatly improved in reliability; that is, they are high in durability. In welding the stationary terminal and the armature to each other, it is unnecessary to use an additional component such as a lead wire; that is, the stationary terminal is welded directly to the armature. Therefore, they can be relatively readily welded together by soldering, laser welding or spot welding. Hence, the switch can be manufactured at relatively low cost without increase in the number of components or in the number of manufacturing steps; that is, the switch should be highly appreciated in practical use.

When the armature is swingably engaged with the stationary terminal through engaging portions thereof, and the armature and the stationary terminal are welded to each other by using portions thereof other than the engaging portions in the first switch, the stationary terminal is directly welded to the armature; however, the welding scarcely affects the tripping motion of the armature. Hence, the switch is excellent in operating performance, having the same effects as the first switch.

When an engaging groove is formed in an engaging piece of the stationary terminal, the base end portion of the armature is engaged with the engaging groove, a first tongue piece extended from the armature is laid on a second tongue piece formed by bending the middle portion of the engaging piece, and the two tongue pieces are welded together in the first switch, the difficulty is more effectively eliminated that the welding adversely affects the tripping motion of the armature; that is, it is further improved in operating to performance. Further, when the first tongue piece extended from the armature is bent, and the end portion of the first tongue piece is welded to the second tongue piece formed by bending the middle portion of the engaging piece, the armature can trip more smoothly, and the difficulty is positively eliminated that the welded portions are for instance cracked when the armature is tripped repeatedly. That is, the switch is high in durability in quality, and in reliability.

When an engaging groove is formed in an engaging piece of the stationary terminal, the base end portion of the armature is engaged with the engaging groove thus formed, an engaging recess is formed in the outer surface of the middle portion of the engaging piece, and a tongue piece extended from the armature is engaged with the engaging recess, and welded to the stationary terminal in the first switch, the engaging piece of the stationary terminal, which is provided for connecting the latter to the armature, is high in mechanical strength. Hence, the switch has a merit that it is higher in durability, in addition to the merits of the first switch.

In a switch of a second aspect of the invention, in which an armature swingably coupled to a stationary terminal is operated by depression of a push button to trip between the contacts, and a flexible movable spring is laid between the stationary terminal and the armature and supported by and welded to the stationary terminal and the armature, the welding will not adversely affect the tripping motion of the armature, and the electrical connection of the stationary terminal and the armature is high in reliability. That is, the switch is excellent in performance.

In a switch of a third aspect of the invention, in which an armature swingably coupled to a stationary terminal is operated by depression of a push button to trip between contacts, an engaging groove is formed in an engaging piece of the stationary terminal, the base end portion of the armature is engaged with the engaging groove thus formed, a tongue piece extended from the armature is placed on a tongue piece protruded from the stationary terminal independently of the engaging piece, and the two tongue pieces are welded together, the difficulty that the welding adversely affects the tripping motion of the armature is more positively eliminated. That is, the switch is much higher in operating performance.

In each of the switches, in order to improve the reliability in electrical connection of the switching elements, namely, the stationary terminal and the armature, they are welded directly to each other. Hence, the switch is smaller in the number of components and in the number of manufacturing steps than the switch which uses lead wires for electrical connecting the switching elements. Accordingly, the switch is lower in manufacturing cost.

What is claimed is:

1. A switch comprising an armature swingably coupled to a stationary terminal operated by depression of a push button to trip between contacts, wherein said stationary terminal is welded to said armature, said armature being swingably engaged with said stationary terminal through engaging portions thereof such that an engaging groove is formed in an engaging piece of said stationary terminal, a base end portion of said armature is engaged with said engaging groove, a first tongue piece extending from said armature is laid on a second tongue piece formed by bending a middle portion of said engaging piece, and said two tongue pieces are welded together whereby said armature and said stationary terminal are welded to each other by using portions thereof other than said engaging portions.

2. A switch comprising an armature swingably coupled to a stationary terminal operated by depression of a push button to trip between contacts, wherein said stationary terminal is welded to said armature, an engaging groove is formed in an engaging piece of said stationary terminal, a base end portion of said armature is engaged with said engaging groove, a first tongue piece extending from said armature is laid on a second tongue piece formed by bending a middle portion of said engaging piece, and said two tongue pieces are welded together.

3. A switch as claimed in claim 2, wherein said first tongue piece extending from said armature is bent, and the end portion of first tongue piece is welded to said second tongue piece formed by bending the middle portion of said engaging piece.

4. A switch comprising an armature swingably coupled to a stationary terminal operated by depression of a push button to trip between contacts, wherein said stationary terminal is welded to said armature, an engaging groove is formed in an engaging piece of said stationary terminal, a base end portion of said armature is engaged with said engaging groove thus formed, an engaging recess is formed in an outer surface of a middle portion of said engaging piece, and a tongue piece extending from said armature is engaged with said engaging recess, and welded to said stationary terminal.

5. A switch comprising an armature swingably coupled to a stationary terminal operated by depression of a push button to trip between contacts, wherein an engaging groove is formed in an engaging piece of said stationary terminal, a base end portion of said armature is engaged with said engaging groove, and a tongue piece extending from said armature through said engaging piece is placed on a tongue piece protruding from said stationary terminal independently of said engaging piece, and said two tongue pieces are welded together.

* * * * *